United States Patent [19]

Dumpis et al.

[11] 4,016,910

[45] Apr. 12, 1977

[54] FUEL DISPENSING NOZZLE WITH AUTOMATIC SHUT-OFF RESPONSIVE TO VAPOR PRESSURE

[75] Inventors: Janis Dumpis, St. Ann; Grenville G. Sutcliffe, Villa Ridge, both of Mo.

[73] Assignee: Husky Corporation, Pacific, Mo.

[22] Filed: Sept. 4, 1975

[21] Appl. No.: 610,460

[52] U.S. Cl. ..... 141/226

[51] Int. Cl.[2] ..... B65B 3/04

[58] Field of Search ..... 141/1, 128, 198, 206–229, 141/290, 301, 302, 392; 251/63.6

[56] References Cited

UNITED STATES PATENTS

| | | | |
|---|---|---|---|
| 1,209,355 | 12/1916 | Sutherland | 251/63.6 |
| 3,101,101 | 8/1963 | Gearhart et al. | 141/226 X |
| 3,811,486 | 5/1974 | Wood | 141/208 |

*Primary Examiner*—Richard E. Aegerter
*Assistant Examiner*—Frederick R. Schmidt
*Attorney, Agent, or Firm*—F. Travers Burgess

[57] ABSTRACT

A fuel dispensing nozzle has a diaphragm responsive to vacuum for shutting off the flow of fuel through the nozzle, the diaphragm chamber normally being vented to atmosphere by a tube extending to the mouth of the spout and closable by fuel in the tank being filled to cause vacuum to actuate the diaphragm and shut off the fuel-flow through the nozzle, and a normally open valve in the vent tube, a piston for closing the vent tube valve in response to vapor pressure in the tank being filled, and conduit means providing vapor communication between the piston and the interior of the tank, whereby to shut off the flow of fuel through the nozzle when predetermined vapor pressure occurs in the tank being filled.

11 Claims, 4 Drawing Figures

FUEL DISPENSING NOZZLE WITH AUTOMATIC SHUT-OFF RESPONSIVE TO VAPOR PRESSURE

BACKGROUND OF THE INVENTION

1. Field of the Invention

The invention relates to fuel dispensing nozzles having automatic shut-off means responsive to fuel level and vapor pressure in the tank being filled.

2. The Prior Art

Prior attempts to utilize vapor pressure in the tank being filled to shut off fuel dispensing nozzles have relied on the vacuum vent tube itself as the conduit for pressure to a diaphragm controlling a valve in the vent tube.

SUMMARY OF THE INVENTION

The invention provides a fuel dispensing nozzle having a vent tube leading from the mouth of the nozzle spout to a vacuum-actuated automatic shut-off diaphragm with improved and simplified means for blocking the vent tube responsive to increases in fuel vapor pressure in a tank being filled above a predetermined value.

To the above end, the invention utilizes a flexible sleeve surrounding the spout as a conduit for vapor from the tank being filled, and provides within the shroud an exposed plunger connected to a valve in the vent tube to close the same when vapor pressure in the tank being filled and the shroud exceeds a predetermined value.

The invention provides a pressure-responsive valve unit for modifying conventional automatic shut-off nozzles to provide a vapor pressure-responsive shut-off.

DETAILED DESCRIPTION OF THE INVENTION

Figure 1:
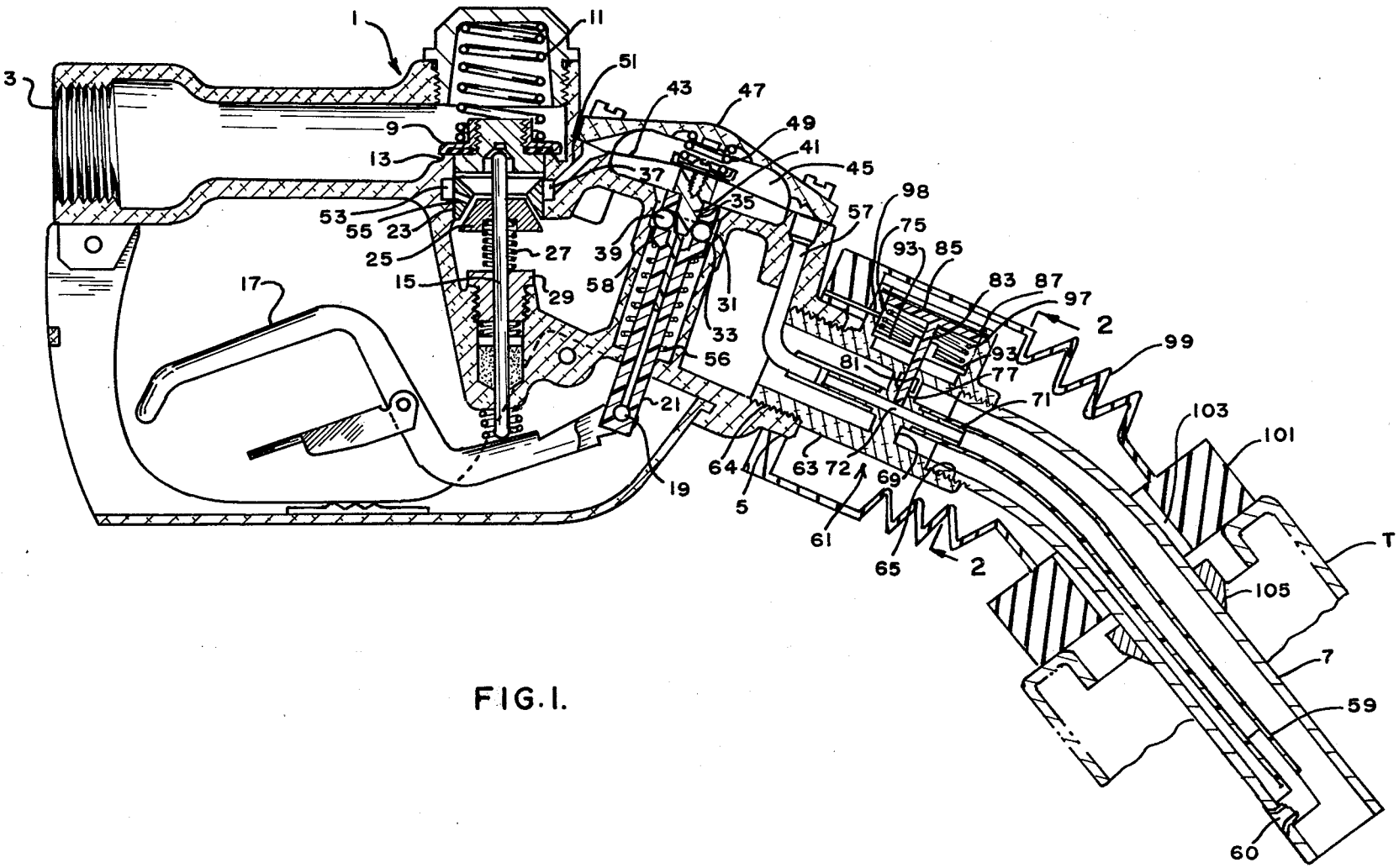
FIG. 1 is a side elevational view, partially in section, of a nozzle embodying the invention.
Figure 3:
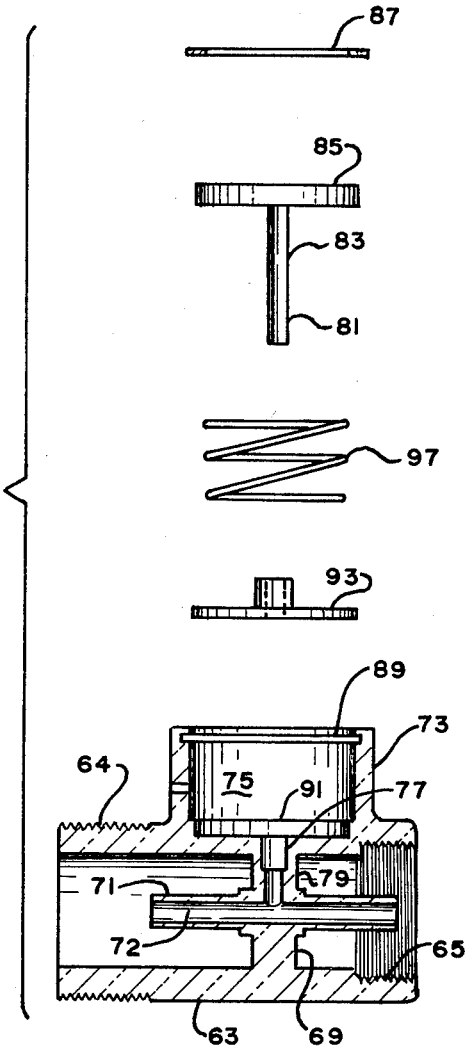
FIG. 3 is an exploded diametral sectional view of the pressure-responsive valve unit taken along line 3—of FIG. 2.
Figure 2:
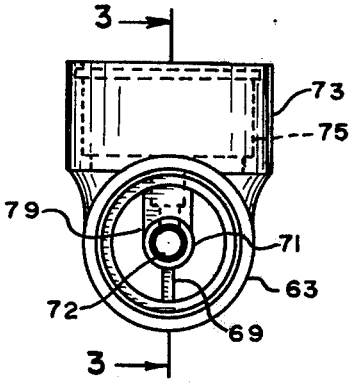
FIG. 2 is an end view of the pressure-responsive valve unit taken from line 2—2 of FIG. 1.
Figure 4:
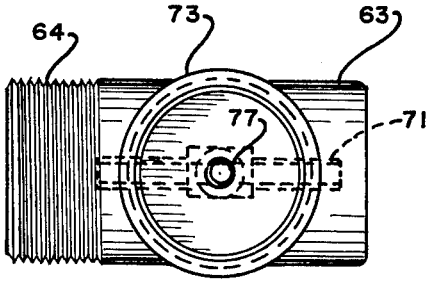
FIG. 4 is a top view of the pressure-responsive valve unit.

The nozzle includes a body generally indicated at 1 and having an inlet 3 to which a fuel hose is connected, and an outlet 5 communicating with a spout 7 insertible into a tank T to be filled.

Within body 1, between inlet 3 and outlet 5, is a main valve 9, biased by spring 11 into sealing engagement with its seat 13 and thereby preventing passage of fuel from inlet 3 to outlet 5. Valve 9 is secured to the upper end of its stem 15 which slides in and projects downwardly from body 1 and an operating lever 17, fulcrumed at 19 on a plunger 21 slidably mounted in body 1, engages the lower end of stem 15 so that upward pressure on lever 17 forces valve 9 upwardly to open position, permitting the flow of fuel past it.

Below valve seat 9 a downwardly facing conical valve seat 23 is mounted in body 1 and a mating frusto-conical poppet valve 25 is slidably mounted on stem 15 and biased upwardly into engagement with seat 23 by a spring 27 seated on stem guide sleeve 29.

In order to cause main valve 9 to close automatically under certain conditions a ball latch device comprising an enlarged chamber 31 is formed in body 1 adjacent the upper end of plunger 21 defining a peripheral shoulder 33 and the upper end of plunger 21 is formed with a central axial bore 35 intersected by a transverse bore 37 at the same height as shoulder 33. Balls 39 are normally seated in transverse bore 37 and project outwardly therefrom into engagement with shoulder 33 to prevent downward movement of plunger 21. Balls 39 are normally positioned in this latching position by latch pin 41 which extends into bore 35 and bears against the balls. Latch pin 41 is secured to a diaphragm 43 mounted in a chamber 45 formed by a cap 47 removably secured to body 1 and a spring 49 seated against cap 47 biases diaphragm 43 and latch pin 41 downwardly into latching engagement with balls 39.

For releasing latch pin 41 a short passage 51 extends from diaphragm chamber 45 to an annular groove 53 in body 1 surrounding poppet valve seat 23 and a radial passageway 55 through the latter connects the neck of seat 23 to annular groove 53.

With the described arrangement, when lever 17 is pressed upwardly to open main valve 9, fulcrum 19 remains stationary because balls 39 prevent downward movement of plunger 21. Pressurized fuel passing valve 9 unseats poppet valve 25 and a venturi effect is formed between poppet valve 25 and its seat 23, creating a vacuum in groove 53, passage 51 and diaphragm chamber 45, which tends to raise the diaphragm against spring 49, and with it, latch pin 41, to permit radial inward movement of balls 39 clear of shoulders 33, and consequent downward movement of plunger 21 to release lever 17 and permit valve stem 15 and with it valve 9 to lower against seat 13 under pressure of spring 11.

Normally diaphragm chamber 45 is vented to atmosphere by a passage 57 in nozzle body 1 which communicates with a vent tube 59 within spout 7, terminating in a port 60 near the mouth of the spout so that, as long as passage 57 and tube 59 are open, the vacuum in chamber 45 will be broken and diaphragm 43 will not release balls 37 to permit downward movement of plunger 21 and consequent automatic closure of main valve 9.

If however, the fuel level in tank T covers vent tube port 60, to block admission of air to tube 59, the vacuum in chamber 45 will cause diaphragm 43 to release balls 59 and thereby cause the closure of main valve 9, preventing further flow of fuel through the nozzle. For returning plunger 21 and lever fulcrum 19 to their normal operating positions, a coil spring 56 is seated at its lower end against body 1 and engages a downwardly facing shoulder 58 on plunger 21.

For making diaphragm 43 responsive also to higher than predetermined vapor pressure in tank T, a self-contained pressure-responsive valve unit generally indicated at 61 is interposed between nozzle body outlet 5 and spout 7. Unit 61 comprises a tubular passageway portion 63 having external threads 64 at one end for securement to body outlet 5 and internal threads 65 at its other end for attachment of spout 7.

Radial struts 69 and 79 support a central tubular element 71 in tubular passageway portion 63, for connection, at its opposite ends, to body passage 57 and vent tube 59, so as to provide a continuous normally open vent passage from diaphragm chamber 45 to port 60.

At its top unit 61 is formed with a hollow circular boss defining a circular chamber normal to the axis of tubular passage 63, and a cylindrical bore 77, through a relatively thicker inwardly extending radial strut 79, connects chamber 75 with the hollow interior of tubular element 71. A gate valve 81 is slidably mounted in bore 77 and is formed with a disc-shaped piston 85 on its outer end, slidably received in circular chamber 75. An expansible retaining ring 87 received in an annular groove 89 in the wall of chamber 75 limits the outward movement of piston 85 and retains it in chamber 75. Near its inner end, chamber 75 is formed with an annular shoulder 91 against which a sealing disc 93 of elastomeric material is seated, disc 93 being centrally apertured at 95 to permit the passage therethrough of valve 81. A coil spring 97 seated against sealing disc 93 biases piston 85 outwardly into engagement with retaining ring 87 to maintain valve 81 in open position, clear of the passage through tubular element 71, and also maintains sealing disc 93 seated against shoulder 91. To eliminate resistance to inward movement of piston 85 resulting from compression of air confined in chamber 75, a small vent opening 98 is formed in its wall 73.

For applying vapor pressure from tank T to piston 85, a generally circular sleeve 99, of substantially greater diameter than spout 7, surrounds valve unit 61 and the adjacent portion of spout 7 and is sealingly secured at one end to nozzle outlet 5 and at its other end mounts a sealing ring 101 of relatively soft elastomeric material engageable with the inlet of tank T to effect a seal therewith. Sleeve 99 is of bellows configuration, the tendency of the bellows to expand axially biasing ring 101 outwardly into sealing engagement with the inlet of tank T. The central opening 103 in ring 101 is of sufficiently larger diameter than spout 7 to permit the free passage of vapor therethrough from tank T to the region of valve unit 61, but sufficiently small that the inner margin of ring 101 engages retaining collar 105 on spout 7.

When vapor pressure in tank T and sleeve 99 exceeds a predetermined value, in excess of the pressure exerted by spring 97 on piston 85, it forces piston 85 and valve 81 inwardly, causing the latter to block passage 72 through tubular element 71, thereby blocking the venting of diaphragm chamber 45 and permitting vacuum from poppet valve seat 23 to raise diaphragm 43 and latch pin 41, releasing plunger 21 and pressure of lever 17 on main valve stem 15, to permit valve spring 11 to close main valve 9 and thereby shut off the flow of fuel through the nozzle. As soon as pressure within sleeve 99 is reduced, as by withdrawal of spout 59 from tank T, spring 97 urges piston 85 outwardly, to withdraw valve 81 from passage 72, thus venting diaphragh chamber 45 to atmosphere and breaking the vacuum therein to return latch pin 41 to its normal position wherein balls 33 are held in latching engagement with shoulder 33 to retain plunger 21 and lever fulcrum 19 in their normal positions.

The details of the structure may be varied substantially without departing from the spirit of the invention and the exclusive use of these modifications coming within the scope of the appended claims is contemplated.

I claim:

1. In a liquid dispensing nozzle, a body having an inlet, an outlet and liquid passage means therebetween including a main valve controlling the flow of liquid from said inlet to said outlet, means resiliently biasing said main valve closed, a spout connected to said outlet and adapted for insertion in the inlet opening of a tank, manually actuated means for opening said main valve against said resilient means, Venturi means in said fuel passage means including a vacuum take-off, a vacuum chamber, means connecting said Venturi vacuum take-off to said vacuum chamber, means responsive to vacuum within said chamber caused by the flow of liquid through said Venturi means operatively connected to said manually actuated means for releasing the same and thereby permitting said resilient means to close said main valve, vent passage means communicating with said vacuum chamber to render said vacuum-responsive means inoperative when said vent passage is open and having a port insertible in the tank with said spout, said vent passage means including a normally open vent control valve, gas conduit means entirely separate from said vent passage means whereby gas pressure in said gas conduit means is unaffected by fluctuations in vacuum in said vent passage means resulting from variations in the rate of flow of liquid through said Venturi means and adapted for sealed communication with the tank inlet opening, a piston exposed directly to gas pressure conditions in said gas conduit means and arranged to close said vent control valve when gas pressure within the tank and said conduit means exceeds a predetermined value, whereby when said port is submerged or when such predetermined pressure conditions occur to close said vent control valve and thereby block said vent passage means, said vacuum-responsive means becomes operative to release said manually-operated means and thereby permit said resilient means to close said main valve.

2. In a liquid dispensing nozzle according to claim 1, said vacuum chamber and vacuum-responsive means being located within said body, said vent passage means having a portion within said body and a separate portion within said spout, said normally open valve being located between said vent passage means portions.

3. In a liquid dispensing nozzle according to claim 2, a valve unit containing said normally open valve forming the connection between said body outlet and said spout.

4. In a liquid dispensing nozzle according to claim 3, said valve unit comprising a tubular passage portion aligned with said body outlet and said spout, a central tubular element connected to said vent passage body and spout portions, said normally open valve being slidably mounted in said unit in a direction transverse thereof.

5. In a liquid dispensing nozzle according to claim 4, said valve unit having a chamber normal to the axis of said tubular passage portion and slidably receiving said piston.

6. In a liquid dispensing nozzle according to claim 5, a spring seated in said piston chamber and biasing said piston outwardly to maintain said normally open valve in open condition.

7. In a liquid dispensing nozzle according to claim 6, said conduit means comprising a sleeve surrounding said spout and adapted for sealing engagement with the tank inlet opening.

8. In a liquid dispensing nozzle according to claim 7, said sleeve mounting at its end a ring-shaped member having a resiliently deformable transverse outer face for sealing engagement with the periphery of the tank inlet.

9. In a liquid dispensing nozzle according to claim 8, resilient means urging said ring-shaped member outwardly along said spout.

10. A self-contained pressure-responsive valve unit in combination with a body outlet and spout of a fuel dispensing nozzle in which the body outlet and spout contain alignable vacuum vent passageways and a gas pressure conduit adapted for sealed communication with the filler inlet opening of a tank in which the spout is insertable, comprising a main tubular portion adapted for aligned connection at its respective ends to the body outlet and the spout, an internal passageway member supported within said tubular portion for aligned connection to vent passageways in the body outlet and spout, a transversely slidable valve member arranged for blocking said internal passageway member and having an enlarged outer end forming a piston, said piston being positionable for exposure to pressure in the pressure conduit, a wall surrounding said piston and forming a chamber slidably receiving said piston, and spring means in said chamber biasing said piston radially outwardly with respect to said main tubular portion to maintain said valve open except when gas pressure on said piston exceeds a predetermined value whereupon to force said piston radially inwardly and cause said valve to block said internal passageway member.

11. A self-contained pressure-responsive valve according to claim 10 wherein said internal passageway member is spaced inwardly of said main tubular member, there being an inwardly extending strut supporting said internal passageway member, said strut being formed with an internal bore intersecting said internal passageway member and slidably receiving said valve.

* * * * *